US006089841A

United States Patent [19]

Meernik et al.

[11] Patent Number: 6,089,841

[45] Date of Patent: Jul. 18, 2000

[54] CRESCENT GEAR PUMP

[75] Inventors: Paul Richard Meernik, Redford; Liping L. Wang, Clinton Township, Macomb County; Francis Hap-Kwong Chen, Rochester Hills, all of Mich.

[73] Assignee: General Motors Corporation, Detroit, Mich.

[21] Appl. No.: 09/106,196

[22] Filed: Jun. 26, 1998

[51] Int. Cl.[7] ..... F01C 1/10

[52] U.S. Cl. ..... 418/170; 418/126; 418/189; 418/80

[58] Field of Search ..... 418/170, 126, 418/189, 80

[56] References Cited

U.S. PATENT DOCUMENTS

| | | | |
|---|---|---|---|
| 1,624,099 | 4/1927 | Haight | 418/170 |
| 3,597,129 | 8/1971 | Crowther . | |
| 3,785,756 | 1/1974 | Langenderfer | 418/170 |
| 4,130,383 | 12/1978 | Moinuddin . | |
| 4,386,892 | 6/1983 | Stich et al. | 418/170 |
| 4,850,814 | 7/1989 | Hertell et al. . | |
| 5,163,826 | 11/1992 | Cozens | 418/170 |
| 5,660,531 | 8/1997 | Merkle et al. . | |

FOREIGN PATENT DOCUMENTS

| | | | |
|---|---|---|---|
| 2381 | 9/1967 | Australia | 418/170 |
| 460361 | 11/1947 | Canada | 418/170 |
| 002028064 | 4/1992 | Canada | 418/170 |
| 379249 | 9/1907 | France | 418/170 |
| 197807 | 7/1978 | Netherlands | 418/170 |
| 404424 | 1/1932 | United Kingdom | 418/170 |

*Primary Examiner*—Thomas Denion
*Assistant Examiner*—Thai-Ba Trieu
*Attorney, Agent, or Firm*—George A. Grove; Patrick M. Griffin

[57] ABSTRACT

A crescent pump including a housing having an inlet port and a discharge port, a driving gear, and a driven gear meshing with driving gear in a gap between the inlet and the discharge ports. External and internal troughs on the driving and the driven gears define pump chambers. A stationary crescent-body has a pair of arc-shaped walls which cooperate with the tips of the external and the internal gear teeth thereon in defining fluid seals. The edges of an inlet ramp at an upstream end of the crescent body and the edges of a discharge ramp at a downstream end of the crescent body define inner and outer upstream and downstream metering orifices which close and open in complementary fashion to maintain constant the rate of fluid leakage from the discharge port toward the inlet port. A pair of shaped metering grooves in the pump housing cooperate in defining a flow path between the discharge port and the inlet port through a succession of trapped volumes between the driving and the driven gears. The flow path has a pair of variable orifices therein calibrated to reduce the fluid pressure in the succession of trapped volumes at a controlled rate.

10 Claims, 3 Drawing Sheets

CRESCENT GEAR PUMP

TECHNICAL FIELD

This invention relates to a positive displacement fluid pump.

BACKGROUND OF THE INVENTION

A typical positive displacement fluid pump referred to generically as a "crescent gear pump" or "crescent pump" includes a housing having an inlet port and a discharge port, a driving gear rotatable on the housing about a first centerline, and a driven gear rotatable on the housing about a second centerline parallel to and laterally separated from the first centerline. External gear teeth on the driving gear mesh with internal gear teeth on the driven gear between the inlet and the discharge ports to isolate the discharge port from the inlet port in the direction of rotation of the driving and the driven gears. External and internal troughs on the driving and the driven gears between the gear teeth thereon define pump chambers in which fluid is transferred from the inlet port to the discharge port. A stationary crescent-body between the driving gear and the driven gear has a pair of arc-shaped walls which fit closely around the driving and the driven gears and cooperate with the tips of the external and the internal gear teeth thereon in defining fluid seals against fluid leakage from the discharge port to the inlet port. Pressure pulses attributable to succeeding ones of such pump chambers closing abruptly at an upstream end of the crescent body and opening abruptly at a downstream end thereof and to similarly abrupt closing and opening of trapped volumes between successive pairs of meshed external and internal gear teeth exert dynamic pressure forces on the driving gear which contribute to audible vibration of the crescent pump.

SUMMARY OF THE INVENTION

This invention is a new and improved crescent pump including a housing having an inlet port and a discharge port, a driving gear rotatable on the housing about a first centerline, and a driven gear rotatable on the housing about a second centerline parallel to and laterally separated from the first centerline. External gear teeth on the driving gear mesh with internal gear teeth on the driven gear in a gap between the inlet and the discharge ports. External and internal troughs on the driving and the driven gears between the gear teeth thereon define pump chambers in which fluid is transferred from the inlet port to the discharge port. A stationary crescent-body has a pair of arc-shaped walls which cooperate with the tips of the external and the internal gear teeth in defining fluid seals which minimize fluid leakage from the discharge port toward the inlet port around the crescent body. The edges of an inlet ramp at an upstream end of the crescent body and the edges of a discharge ramp at a downstream end of the crescent body define inner and outer upstream and downstream metering orifices which close and open in complementary fashion to maintain constant the rate of fluid leakage around the crescent-body. A pair of shaped metering grooves in the pump housing cooperate in defining a flow path across the gap between the discharge port and the inlet port through a succession of trapped volumes between the driving and the driven gears. The flow path has a pair of variable orifices therein which exhaust successive trapped volumes at a rate calculated to maintain substantially constant the net pressure force on the driving gear in the gap between the inlet port and the discharge port.

DESCRIPTION OF THE PREFERRED EMBODIMENT

Figure 1:
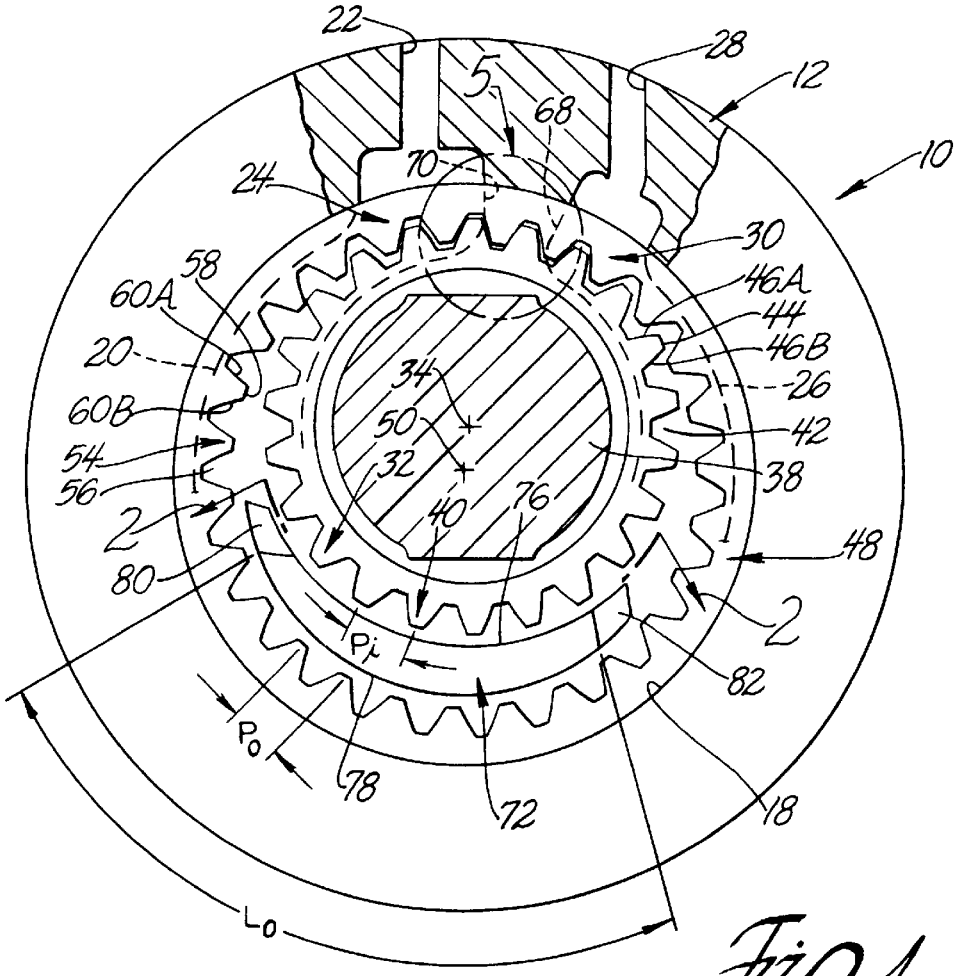
FIG. 1 is a schematic view of a crescent pump according to this invention.

Referring to FIGS. 1–5, a schematically represented positive displacement crescent pump 10 according to this invention includes a housing 12, a first side plate 14, and a second side plate 16. The first and second side plates 14,16 close opposite ends of a circular bore 18 in the housing 12. A schematically represented arc-shaped slot 20 in the side plate 14 is connected to a fluid reservoir, not shown, through a passage 22 in the housing 12 and defines an inlet port 24 of the crescent pump. A second schematically represented arc-shaped slot 26 in the side plate 14 is connected to a fluid operated device, not shown, e.g. a fluid motor, through a second passage 28 in the housing 12 and defines a discharge port 30 of the crescent pump.

A driving gear 32 of the crescent pump in the circular bore 18 between the side plates 14,16 is supported on the housing 12 for rotation about a first centerline 34 with a pair of annular end walls 36A,36B of the driving gear closely facing the side plates 14,16, respectively. Torque for rotating the driving gear counterclockwise, FIG. 1, about the first centerline 34 is transferred from an external prime mover, not shown, to the driving gear through a drive shaft 38. A plurality of external gear teeth 40 around the periphery of the driving gear are separated by a corresponding plurality of external troughs 42. Each of the external gear teeth 40 has a tip 44 and a pair of flanks 46A,46B on opposite sides of the tip, FIGS. 1,5 and 8A–8C.

A ring-shaped driven gear 48 of the crescent pump is journaled in the circular bore 18 between the side plates 14,16 around the driven gear for rotation about a second centerline 50 parallel to and laterally separated from the first centerline 34. A pair of annular end walls 52A,52B of the driven Rear closely face the side plates 14,16, respectively. A plurality of internal gear teeth 54 in an inside cylindrical wall of the driven gear 48 are separated by a corresponding plurality of internal troughs 56. Each of the internal gear teeth 54 has a tip 58 and a pair of flanks 60A,60B on opposite sides of the tip.

Figure 5:
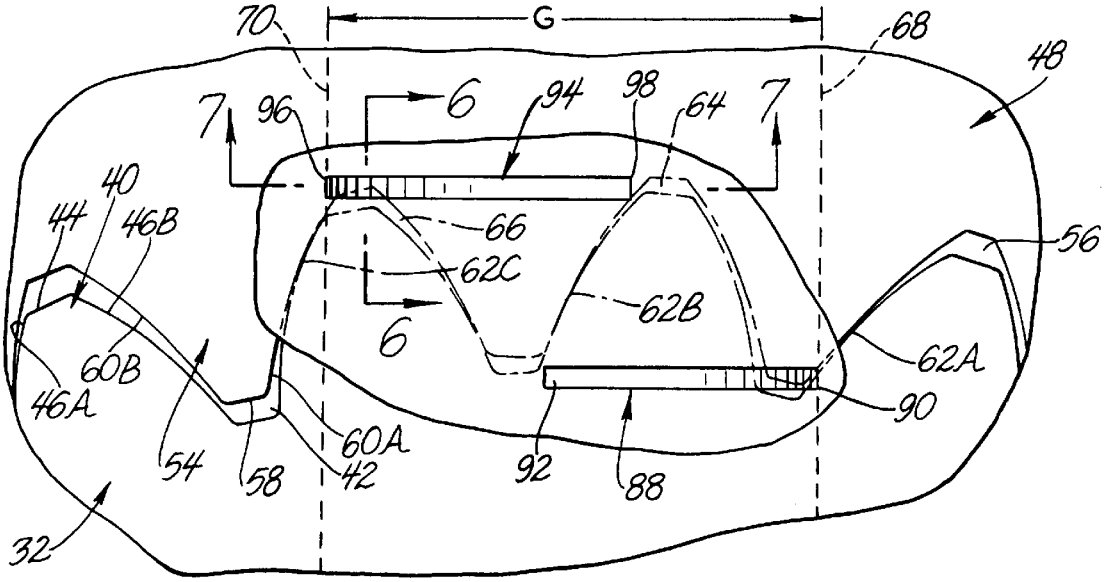
FIG. 5 is an enlarged partially broken-away view of the portion of FIG. 1 identified by the reference circle 5 in FIG. 1.
Figure 6:
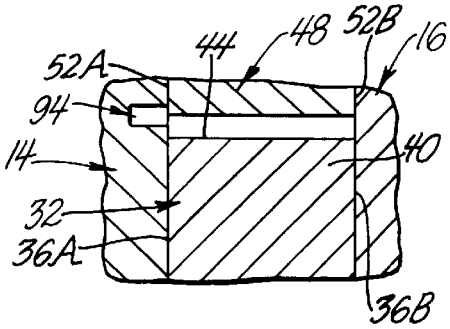
FIG. 6 is a sectional view taken generally along the plane indicated by lines 6—6 in FIG. 5.
Figure 7:
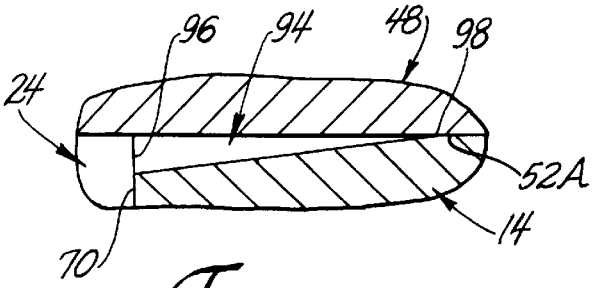
FIG. 7 is a sectional view taken generally along the plane indicated by lines 7—7 in FIG. 5.

In the relative positions of the driving gear 32 and the driven gear 48 depicted in FIG. 5, the flanks 46A of a plurality of external gear teeth 40 on the driving gear bear against the flanks 60A of a corresponding plurality of internal gear teeth 54 on the driven gear at respective ones of a plurality of three seal points 62A,62B,62C. Driving torque is transferred from the driving gear to the driven gear at the seal points 62A–62C which also cooperate in defining a first trapped volume 64 and a second trapped volume 66 each of which, in the relative positions of the driving and driven gears depicted in FIG. 5, spans about one-half of a gap "G", FIGS. 5 and 8A–8C, between a downstream end 68 of the discharge port 30 and an upstream end 70 of the inlet port 24.

As seen best in FIGS. 1–4, a crescent-shaped chamber between the driving gear and the driven gear overlaps the inlet port 24 and the discharge port 30. A crescent-body 72 in the crescent-shaped chamber is rigidly secured to the housing and includes a pair of flat sides 74A,74B sealed against the side plates 14,16, an arc-shaped inner wall 76 facing the driving gear and separated radially from the tips 44 of the external gear teeth thereon by a clearance dimension "CL" and an arc-shaped outer wall 78 facing the driven gear and separated from the tips 58 of the internal gear teeth thereon by the clearance dimension CL. The clearance dimension CL is illustrated in exaggerated fashion in FIGS. 3–4 for clarity.

The flat side 74B of the crescent body 72 has an inlet ramp 80 at an upstream end thereof facing the inlet port 24 and a discharge ramp 82 at a downstream end thereof facing the discharge port 30. A length dimension "$L_i$" of the inner wall between the ramps 80,82 is a whole multiple of a circumferential pitch dimension "$P_i$", FIG. 1, between the tips 44 of the external gear teeth 40 on the driving gear. The length of the edge of the inlet ramp 80 where it intersects the inner wall 76 and the length of the edge of the discharge ramp 82 where it intersects the inner wall are each equal to the pitch dimension $P_i$. A length dimension "$L_o$" of the outer wall 78 between the ramps 80,82 is a whole multiple of a circumferential pitch dimension "$P_o$", FIG. 1, between the tips 58 of the internal gear teeth 54 on the driven gear. The length of the edge of the inlet ramp 80 where it intersects the outer wall 78 and the length of the edge of the discharge ramp 82 where it intersects the outer wall are each equal to the pitch dimension $P_o$.

The external and internal troughs 42,56 define discrete pump chambers which transfer fluid around the crescent-body from the inlet port 24 to the discharge port 30. The edge of the inlet ramp 80 where it intersects the inner wall 76 of the crescent-body defines a wedge-shaped inner upstream metering orifice 84, FIG. 2, between the inlet port and the external troughs 42 which closes as the external troughs traverse the length of the inlet ramp. The edge of the discharge ramp 82 where it intersects the inner wall 76 defines a wedge-shaped inner downstream metering orifice 86, FIG. 2, between the discharge port and the external troughs 42 which opens as the external troughs traverse the length of the discharge ramp. Corresponding wedge-shaped outer upstream and outer downstream metering orifices, not shown, between the internal troughs 56 and the inlet and the discharge ports 24,30 are defined by the edges of the inlet and the discharge ramps where they intersect the outer wall 78 of the crescent-body.

In an ordinary crescent pump of the prior art, not shown, the tips of the external and the internal gear teeth on the driving and driven gears cooperate with the inner and the outer walls of the crescent-body in defining multi-stage inner and outer seals against fluid backflow or leakage around the crescent-body from the discharge port toward the inlet port. The number of external and internal gear tooth tips fully sealed against the inner and the outer walls of the crescent-body varies cyclically by one gear tooth tip as the driving and driven gears rotate. The resulting cyclic variation of the fluid leakage rate around the crescent-body causes pressure pulses in the discharge port and corresponding dynamic pressure forces on the driving gear which have been observed to contribute to pump vibration. In the crescent pump 10 according to this invention, the fluid leakage rate around the crescent-body is maintained substantially constant to minimize such pressure pulses and corresponding dynamic pressure forces.

Figure 2:
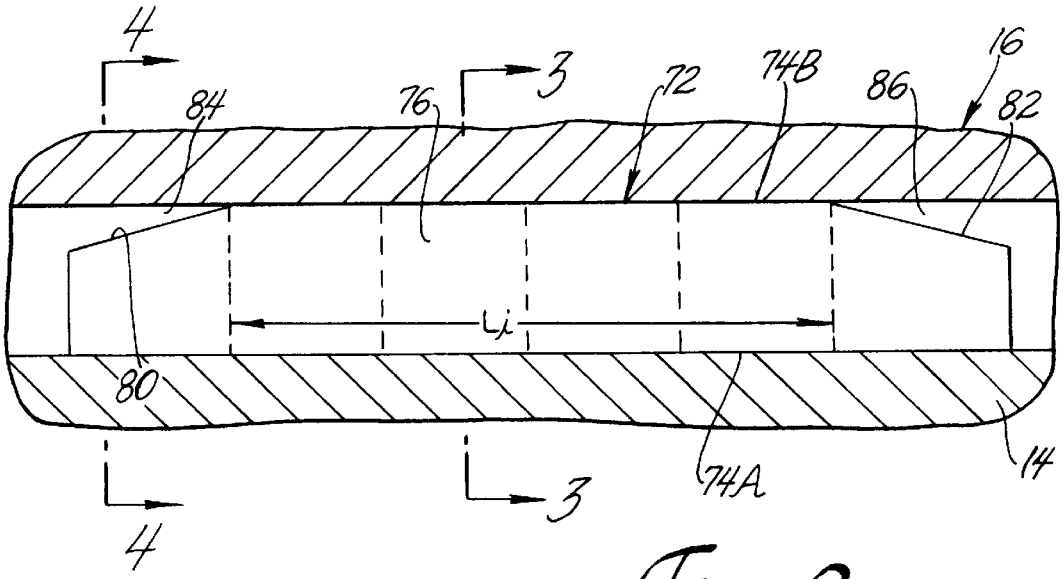
FIG. 2 is an enlarged sectional view taken generally along an arc indicated by lines 2—2 in FIG. 1.
Figure 3:
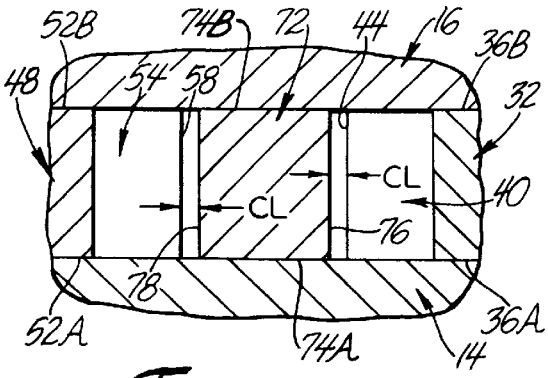
FIG. 3 is a sectional view taken generally along the plane indicated by lines 3—3 in FIG. 2.
Figure 4:
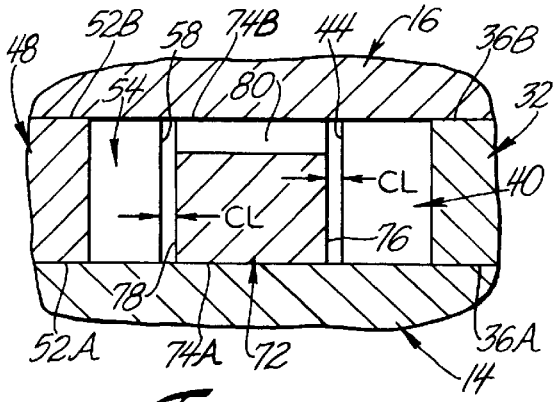
FIG. 4 is a sectional view taken generally along the plane indicated by lines 4—4 in FIG. 2.

More particularly, when the crescent pump 10 is operating, a continuous succession of the pump chambers defined by the external troughs 42 traverse the inner wall 76 of the crescent-body from left to right, FIG. 2, to transfer fluid from the inlet port to the discharge port. The tips 44 of the external gear teeth in the span $L_i$ of the inner wall are fully sealed and define a multi-stage inner fluid seal against leakage from the discharge port toward the inlet port. The combined restriction to fluid leakage afforded by these seals varies as the number of external gear tooth tips 44 fully sealed within the span $L_i$ varies cyclically between (n) and (n+1), where (n) is $L_i$ divided by $P_i$. The tips 58 of the internal gear teeth in the span $L_o$ of the outer wall are fully sealed and define a multi-stage outer fluid seal against leakage from the discharge port toward the inlet port. The combined restriction to fluid leakage afforded by these seals varies as the number of internal gear tooth tips 58 fully sealed within the span $L_o$ varies cyclically between (n') and (n'+1), where (n') is $L_o$ divided by $P_o$.

At the same time, a succession of external troughs 42 ahead of the span $L_i$ communicate with the inlet port through the inner upstream metering orifice 84 which closes as the succession of external troughs traverse length of the inlet ramp 80 until fully shrouded by the inner wall 76. Likewise, a corresponding succession of external troughs 42 fully shrouded by the inner wall 76 at the end of the span $L_i$ communicate with the discharge port through the inner downstream metering orifice 86 which opens as the succession of external troughs traverse length of the discharge ramp 82. The rates at which the upstream and downstream metering orifices 84,86 close and open, respectively, are calculated to vary the combined restriction to leakage afforded by both metering orifices in complementary fashion relative to the combined restrictions afforded by the fully sealed gear tooth tips in the span $L_i$ so that the total restriction against leakage toward the inlet port between inner wall 76 and the driving gear 32 remains substantially constant regardless of the position of the driving gear relative to the crescent-body.

Similarly, a succession of the internal troughs 56 ahead of the span $L_o$ of the outer wall 78 communicate with the inlet port through the aforesaid outer upstream metering orifice which closes as the succession of internal troughs traverse the length of the inlet ramp 80 until fully shrouded by the outer wall. A corresponding succession of internal troughs 56 fully shrouded by the outer wall 78 at the end of the span $L_o$ communicate with the discharge port through the aforesaid outer downstream metering orifice which opens as the succession of internal troughs traverse the length of the discharge ramp. The rates at which the outer upstream and outer downstream metering orifices close and open are calculated to vary the combined restriction to leakage afforded by both metering orifices in complementary fashion relative to the combined restrictions afforded by the fully sealed gear tooth tips in the span $L_o$ so that the total restriction against leakage toward the inlet port between outer wall and the driven gear remains substantially constant regardless of the position of the driven gear relative to the crescent-body.

Referring to FIGS. 5–7 and 8A–8C, the crescent pump 10 further includes a first shaped metering groove 88 in the side plate 14 spanning a fraction of the gap G between the inlet and the discharge ports 24,30. The first metering groove 88 has a wedge-shaped bottom which defines a deep first end 90 of the groove exposed to the discharge port 30 and a second end 92 of the groove where the bottom intersects the surface of the side plate 14 facing the driving and the driven gears 32,48. The first metering groove cooperates with the end wall 36A of the driving gear in defining a passage open to the discharge port which becomes more restricted in the direction of rotation of the driving and the driven gears.

A second metering groove 94 in the side plate 14 also spans a fraction of the gap G between the inlet and the discharge ports and has a wedge-shaped bottom defining a deep first end 96 of the groove exposed to the inlet port 24 and a second end 98 of the groove where the bottom intersects the surface of the side plate 14 facing the driving and the driven gears 32,48. The second metering groove cooperates with the end wall 52A of the driven gear in defining a passage open to the inlet port which becomes less restricted in the direction of rotation of the driving and the driven gears.

In the relative positions of the driving and driven gears depicted in FIG. 5, the second trapped volume 66 is exposed to the inlet port 24 through the deep end 96 of the second metering groove 94 so that the fluid pressure in the second trapped volume is substantially equal to the low fluid pressure in the inlet port. Conversely, the first trapped volume 64 is exposed to the discharge port 30 through the deep end 90 of the first metering groove 88 so that the fluid pressure in the first trapped volume is substantially equal to the high fluid pressure in the discharge port. In that circumstance, the net pressure force on the driving gear 32 in the gap G between the inlet and the discharge ports is attributable substantially completely to the fluid in the first trapped volume 64 and is thus proportional to the high fluid pressure in the first trapped volume.

Figure 8A:
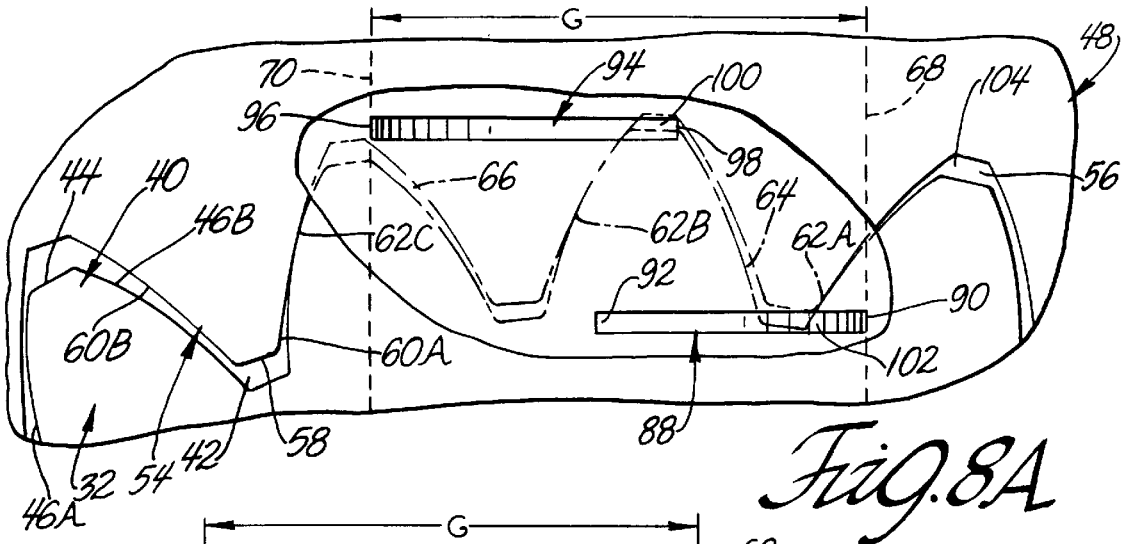
FIGS. 8A–8C are similar to FIG. 5 showing structural elements of the crescent pump according to this invention in different relative positions.

As the driving and the driven gears 32,48 rotate counterclockwise from their relative positions depicted in FIG. 5 to their relative positions depicted in FIG. 8A, the first trapped volume 64 overlaps the second end 98 of the second metering groove 94 and thus becomes exposed to the inlet port 24 through a variable orifice 100 defined between the second metering groove and the end wall 52A of the driven gear which orifice is relatively small and, therefore, highly restricting. The first trapped volume 64 also remains exposed to the discharge port through a variable orifice 102 defined between the first metering groove 88 and the end wall 36A of the driving gear which orifice is relatively large and, therefore, non-restricting. The metering grooves 88,94 thus define a flow path between the discharge and the inlet ports through the first trapped volume 64 having the variable orifices 100,102 in series connection therein.

As the first trapped volume traverses the gap G from its position depicted in FIG. 5 to its position depicted in FIG. 8A, an open volume 104 behind the first trapped volume communicates with the discharge port and overlaps the gap G. The fluid pressure in the open volume 104 equals the high fluid pressure in the discharge port 30 and exerts a pressure force on the driving gear 32 in the gap G. The series connected variable orifices 100,102 in the aforesaid flow path through the first trapped volume 64 are calibrated to reduce the pressure force on the driving gear attributable to fluid in the first trapped volume at the same rate that the pressure force on the driving gear attributable to fluid in the open volume 104 increases. Accordingly, the net pressure force on the driving gear in the gap G remains substantially constant.

Figure 8B:
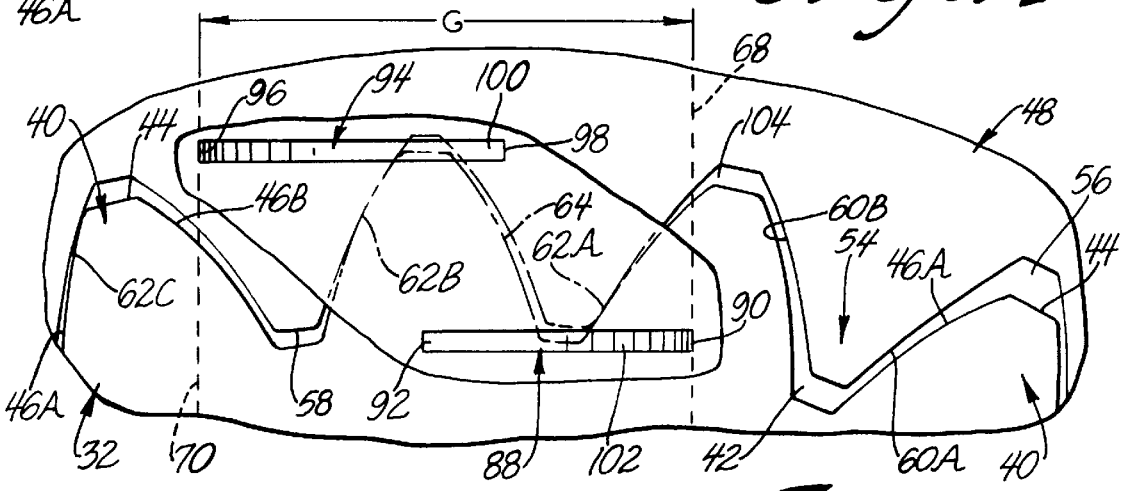
Figure 8C:
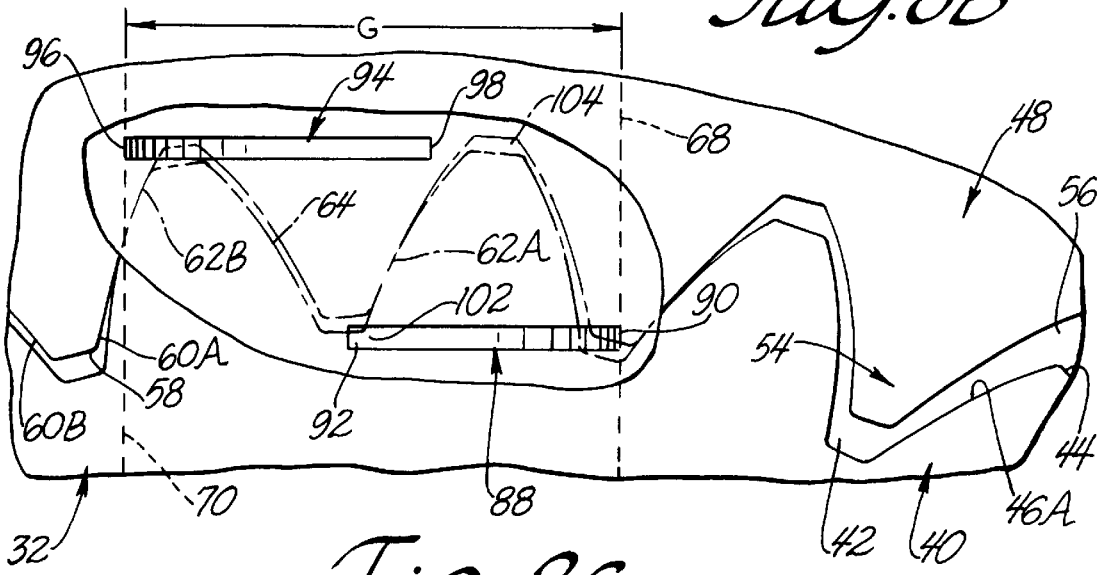

As the driving and the driven gears rotate further counterclockwise from their relative positions depicted in FIG. 8A to their relative positions depicted in FIGS. 8B–8C, the flow area of the variable orifice 100 increases and the flow area of the variable orifice 102 decreases and the fluid pressure in the first trapped volume 64 decreases smoothly toward the low fluid pressure prevailing at the inlet port. At the same time, the open volume 104 further overlaps the gap G and the pressure force on the driving gear attributable to fluid therein at the high fluid pressure prevailing in the discharge increases. Again, the series connected orifices 100,102 in the aforesaid flow path through the first trapped volume 64 are calibrated to reduce the pressure force on the driving gear attributable to fluid in the first trapped volume at the same rate that the pressure force on the driving gear attributable to fluid in the open volume 104 increases. The result is that the net pressure force on the driving gear in the gap G remains substantially constant as a succession of trapped volumes traverse the gap G so that pressure pulses characteristic of prior crescent pumps and attributable to abrupt exposure of such trapped volumes to the inlet port do not occur. The crescent pump 10 according to this invention, therefore, operates with less vibration than prior crescent pumps.

Having thus described the invention, what is claimed is:

1. A crescent gear pump comprising:

a housing having an inlet port and a discharge port, a driving gear rotatably supported on said housing including a plurality of external gear teeth each having a tip separated from the tip of an adjacent external gear tooth by a circumferential pitch dimension "$P_i$", a driven gear rotatably supported on said housing around said driven gear including a plurality of internal gear teeth each having a tip separated from the tip of an adjacent internal gear tooth by a circumferential pitch dimension "$P_o$" and meshing with said external gear teeth on said driving gear in a gap between said inlet port and said discharge port, a pair of side plates attached to said housing on opposite sides of said driving gear and said driven gear, a crescent-body in a crescent-shaped chamber between said driving gear and said driven gear having a pair of flat sides sealed against respective ones of said pair of side plates, an arc-shaped inner wall on said crescent-body facing said driving gear and cooperating with said tip on each of a plurality of said external gear teeth in defining a corresponding plurality of fluid seals between said driving gear and said crescent-body, said inner wall including a segment having a length dimension "$L_i$" equal to a whole multiple of said circumferential pitch dimension $P_i$ so that a plurality of full seals are defined between said tips of said external gear teeth and said inner wall varying in number during rotation of said driving gear between (n) and (n+1), where (n) is $L_i$ divided by $P_i$, and the combined restriction against fluid leakage afforded by said full seals varies from minimum with (n) full seals to maximum with (n+1) full seals, an inlet ramp on a selected one said pair of flat sides of said crescent body facing each of said inlet port and a corresponding one of said pair of side plates having an edge where said inlet ramp intersects said inner wall of said crescent body cooperating with said corresponding one of said pair of side plates in defining an inner upstream metering orifice between said inlet port and a succession of said external troughs having a flow area which varies from maximum when each of said succession of said external troughs is immediately ahead of said segment of said inner wall having said length dimension $L_i$ to zero when each of said succession of said external troughs is fully shrouded by said inner wall within said segment having said length dimension $L_i$, and a discharge ramp on said selected one of said pair of flat sides of said crescent body facing each of said discharge port and said corresponding one of said pair of side plates having an edge where said discharge ramp intersects inner wall of said crescent body cooperating with said corresponding one of said pair of side plates in defining an inner downstream metering orifice between said discharge port and said succession of said external troughs having a flow area which varies from zero when each of said succession of said external troughs is fully shrouded by said inner wall within said segment having said length dimension $L_i$ to maximum when each of said succession of said external troughs is immediately behind said segment of said inner wall having said length dimension $L_i$, the restriction against fluid leakage afforded by the combined flow areas of said inner upstream metering orifice and said inner downstream metering orifice varying in complementary fashion relative to the restriction against fluid leakage afforded by said full fluid seals within said segment of said inner wall having said length dimension $L_i$ so that the rate of fluid leakage from said discharge port toward said inlet port between said crescent-body and said driving gear is substantially constant.

2. The crescent gear pump recited in claim 1 wherein:

said edge where said inlet ramp intersects said inner wall of said crescent body spans a distance along said inner wall of said crescent body equal to said circumferential pitch dimension $P_i$ between said tips of said external gear teeth on said driving gear.

3. The crescent gear pump recited in claim 2 wherein:

said edge where said discharge ramp intersects said inner wall of said crescent body spans a distance along said inner wall of said crescent body equal to said circumferential pitch dimension $P_i$ between said tips of said external gear teeth on said driving gear.

4. The crescent gear pump recited in claim 3 further comprising:

an arc-shaped outer wall on said crescent-body facing said driven gear and cooperating with said tip on each of a plurality of said internal gear teeth in defining a corresponding plurality of fluid seals between said driven gear and said crescent-body, said outer wall including a segment having a length dimension "$L_o$" equal to a whole multiple of said circumferential pitch dimension $P_o$ so that a plurality of full seals are defined between said tips of said internal gear teeth and said outer wall varying in number during rotation of said driven gear between (n') and (n'+1), where (n') is $L_o$ divided by $P_o$, and the combined restriction against fluid leakage afforded by said full seals varies from minimum with (n') full seals to maximum with (n'+1) full seals, said inlet ramp intersecting said outer wall of said crescent body at an edge which cooperates with said corresponding one of said pair of side plates in defining an outer upstream metering orifice between said inlet port and a succession of said internal troughs having a flow area which varies from maximum when each of said succession of said internal troughs is immediately ahead of said segment of said outer wall having said length dimension $L_o$ to zero when each of said succession of said internal troughs is fully shrouded by said inner wall within said segment having said length dimension $L_o$, said discharge ramp intersecting said outer wall of said crescent body at an edge which cooperates with said corresponding one of said pair of side plates in defining an outer downstream metering orifice between said discharge port and said succession of said internal troughs having a flow area which varies from zero when each of said succession of said internal troughs is fully shrouded by said outer wall within said segment having said length dimension $L_o$ to maximum when each of said succession of said internal troughs is immediately behind said segment of said outer wall having said length dimension $L_o$, and the restriction against fluid leakage afforded by the combined flow areas of said outer upstream metering orifice and said outer downstream metering orifice varying in complementary fashion relative to the restriction against fluid leakage afforded by said full fluid seals within said segment of said outer wall having said length dimension $L_o$ so that the rate of fluid leakage from said discharge port toward said inlet port between said crescent-body and said driven gear is substantially constant.

5. The crescent gear pump recited in claim 4 wherein:

said edge where said inlet ramp intersects said outer wall of said crescent-body spans a distance along said outer wall equal to said circumferential pitch dimension $P_o$ between said tips of said internal gear teeth on said driven gear.

6. The crescent gear pump recited in claim 5 wherein:

said edge where said discharge ramp intersects said outer wall of said crescent-body spans a distance along said outer wall equal to said circumferential pitch dimension $P_o$ between said tips of said internal gear teeth on said driven gear.

7. A crescent gear pump comprising:

a housing having a circular bore therein, a side plate on said housing closing said circular bore and having an inlet port and a discharge port therein, a driving gear rotatably supported on said housing in said circular bore including a plurality of external gear teeth and an end wall facing said side plate, a driven gear rotatably journaled in said circular bore around said driving gear including a plurality of internal gear teeth meshing with a plurality of said external gear teeth on said driving gear in a gap between said inlet port and said discharge port and an end wall facing said side plate, the meshing ones of said internal gear teeth and said external gear teeth forming a succession of trapped volumes wholly within said gap and a corresponding succession of open volumes behind said trapped volumes exposed to said discharge port and progressively more completely overlapping said gap, a passage means operative to define a fluid passage from said discharge port to said inlet port through each of said succession of trapped volumes, a first variable orifice means operative to define in said passage means the first variable orifice between said each of said succession of said trapped volumes and said discharge port the flow area of which decreases concurrent with increasing separation between said discharge port and each of said succession of said trapped volumes, and a second variable orifice means operative to define in said passage means the second variable orifice between each of said succession of said trapped volumes and said inlet port the flow area of which increases concurrent with increasing separation between said discharge port and each of said succession of said trapped volumes, said first and said second variable orifices cooperating to reduce the fluid pressure in each of said succession of said trapped volumes at a rate calculated to decrease the corresponding pressure force on said driving gear at a rate substantially equal to the rate of increase of a pressure force on said driving gear in said gap attributable to fluid pressure in each of said succession of open volumes so that the net pressure force on said driving gear in said gap is substantially constant.

8. The crescent gear pump recited in claim 7 wherein said passage means comprises:

a first groove in said side plate facing said end wall of said driving gear spanning substantially one half of said gap between said discharge port and said inlet port and overlapping each of said succession of said trapped volumes and having a first end exposed to said discharge port, and a second groove in said side plate facing said end wall of said driven gear spanning substantially one half of said gap between said discharge port and said inlet port and overlapping each of said succession of said trapped volumes and having a first end exposed to said inlet port.

9. The crescent gear pump recited in claim 8 wherein said first variable orifice means comprises:

a wedge-shaped bottom in said first groove tapering from a maximum depth at said first end thereof to a minimum depth at a second end thereof where said wedge-shaped bottom intersects a surface of said side plate facing said end wall of said driving gear.

10. The crescent gear pump recited in claim 9 wherein said second orifice means comprises:

a wedge-shaped bottom in said second groove tapering from a maximum depth at said first end thereof to a minimum depth at a second end thereof where said wedge-shaped bottom intersects said surface of said side plate facing said end wall of said driven gear.

* * * * *